US006174336B1

(12) United States Patent
Kondo

(10) Patent No.: US 6,174,336 B1
(45) Date of Patent: Jan. 16, 2001

(54) DYEING AND SHRINKING OF CLOTHING UTILIZING DYEING PROCESSING AND METHOD OF MANUFACTURING THE SAME

(76) Inventor: Norichika Kondo, 22 Aza-Shimonaka, Narumi-cho, Midori-ku, Nagoya-shi, Aichi (JP)

( * ) Notice: Under 35 U.S.C. 154(b), the term of this patent shall be extended for 0 days.

(21) Appl. No.: 09/401,786

(22) Filed: Sep. 22, 1999

(51) Int. Cl.[7] ..... A41D 1/18; A41D 27/00; D06P 5/00

(52) U.S. Cl. ..... 8/482; 8/494; 8/933

(58) Field of Search ..... 8/482, 494, 933

(56) References Cited

U.S. PATENT DOCUMENTS 4,951,483 * 8/1990 Van Olphen .

FOREIGN PATENT DOCUMENTS 54-68484 6/1979 (JP) .
54-68500 6/1979 (JP) .
63-256779 * 10/1988 (JP) .
1-162882 * 6/1989 (JP) .

* cited by examiner

*Primary Examiner*—Margaret Einsmann
(74) *Attorney, Agent, or Firm*—Armstrong, Westerman, Hattori, McLeland & Naughton

(57) ABSTRACT

A whole surface or a portion of a cloth, such as a body, a breast or a waist, is subjected to a tying process such as rolling-up, tying, folding or tight tying, and then the cloth is dyed by a dyeing method such as immersion. The dyed cloth is further subjected to a shrinking process, for example, a heat treatment so as to form a tie dyeing and shrinking clothing piece, and the size of the tie dyeing and shrinking clothing piece is greatly reduced by utilizing the elasticity based on the tie dyeing and shrinking process.

8 Claims, 7 Drawing Sheets

DYEING AND SHRINKING OF CLOTHING UTILIZING DYEING PROCESSING AND METHOD OF MANUFACTURING THE SAME

BACKGROUND OF THE INVENTION

1. Field of the Invention

The present invention relates to tie dyeing and shrinking of a piece of clothing utilizing a tie dyeing processing and a method of manufacturing the same.

2. Description of the Prior Art

In the prior art, tie dyeing products are formed freely in that the dye stuff does not enter tied or covered portions that are formed by various tying processes such that the undyed portions are expressed as patterns. Otherwise, the dyed portions, such as the tied portions by various tying processings or the covered portions, are previously dyed or dyed afterward. It is well known that patterns resulting from various dyeing methods are quite numerous.

In the present situation, these tie dyeing processes are adopted so that patterns or designs are expressed, and while succession of traditional technical art of hand tie dyeing is intended, ornamental property, aesthetic sense and elegance for the tie dyeing article (clothing) are raised. In cotton products (cotton stuff) such as a bathrobe or a blouse, advantages of providing a sense of high quality and enabling utilization such as, for example, an outdoor dress or a visiting dress by providing the sense of high quality, are useful for the practical benefit.

As above described, in the present situation, the tie dyeing process is adopted so as to raise the ornamental property, the aesthetic sense and the elegance of the tie dyeing article, and in cotton products such as a bathrobe or a blouse, the tie dyeing process provides advantages of a sense of high quality and enabling utilization such as an outdoor dress or a visiting dress. However, the utilization in such manner means that the tie dyeing article is limited to only one aspect.

For example, when the elasticity based on the tie dyeing process and the physical property of the cloth are utilized effectively, it is clear that the tie dyeing article has better characteristics and its value as an article for commerce is improved and the field of utilization can be developed. For example, when a clothing piece such as a blouse with elasticity is manufactured utilizing the elasticity and the physical property, the clothing piece is fitted to a human body to express the figured line of the human body gently without producing creases (i.e., to fully express the figure of a beautiful woman), or utilizing the small dimension of the blouse so that the clothing can be accommodated compactly, and this is useful for journeys, accommodations, or the like. The tie dyeing process can also be utilized for the function as essentially required by the clothing piece. For example, the tie dyeing process is useful for functions such as tightening of sleeve ends or tightening of a belly.

SUMMARY OF THE INVENTION

The invention in claim 1 intends that the size of a clothing piece is greatly reduced by utilizing the elasticity based on the tie dyeing and shrinking process, and the resulting clothing piece can be fitted to human body.

Figured line of the human body can be expressed gently without producing creases, and the elasticity and physical property possessed by the cloth are exhibited with excellent characteristics, thereby the value as an article for commerce is improved and the utilization field is developed, or the clothing piece can be accommodated compactly.

The invention in claim 1 relates to a tie dyeing and shrinking clothing piece utilizing tie dyeing processing, wherein a whole cloth is subjected to tying processing such as rolling up, tying, folding or tight tying by the tie dyeing processing, and then subjected to the tie dyeing and shrinking processing as to form a tie dyeing and shrinking clothing piece, and the size of the tie dyeing and shrinking clothing piece is greatly reduced by utilizing the elasticity based on the tie dyeing and shrinking process.

The invention of claim 2 is that the size of a tie dyeing and shrinking clothing piece is greatly reduced by utilizing the elasticity based on the tie dyeing and shrinking process, and the tie dyeing and shrinking clothing piece can be fitted to a human body, and the clothing is fitted to a prescribed portion of the human body, and figured line of the human body can be expressed gently without producing creases in the similar manner as that of claim 1.

The invention of claim 2 relates to a tie dyeing and shrinking clothing piece utilizing the tie dyeing process, wherein in order to obtain fitting to a human body, a portion of the cloth corresponding to a prescribed portion such as a body, a breast, a waist or a suitable portion is subjected to the tying processing, such as rolling-up, tying, folding or tight tying, by the tie dyeing processing, and then is subjected to the tie dyeing and shrinking processing thereby a tie dyeing and shrinking clothing is formed, and the size of the tie dyeing and shrinking clothing piece is reduced greatly by utilizing the elasticity based on the tie dyeing and shrinking process.

PREFERRED EMBODIMENT OF THE INVENTION

An embodiment of the present invention will be described based on the accompanying drawings.

Figure 1:
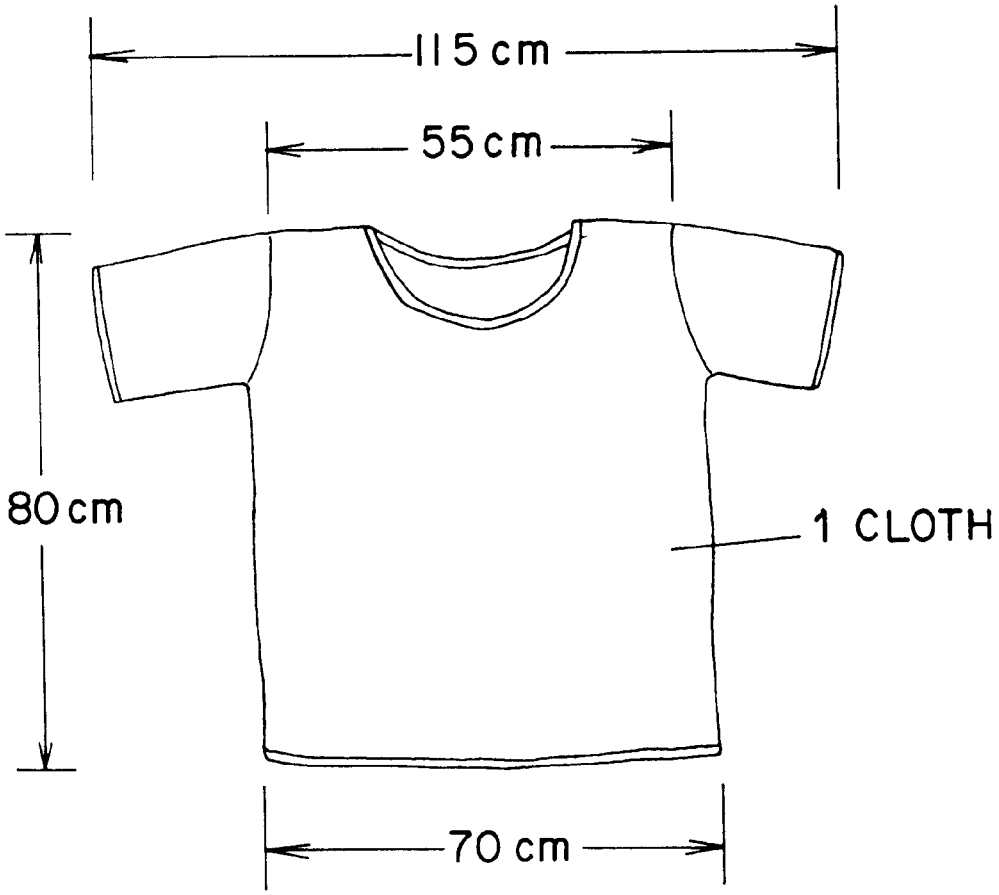
FIG. 1 is a diagram showing a developed state of a piece of cloth.
Figure 2A:
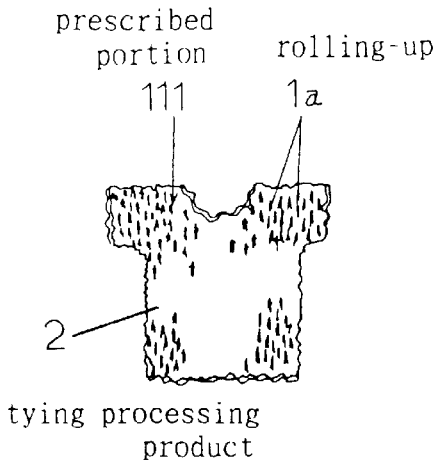
FIG. 2 includes diagrams showing tie dyeing processing of the cloth in reduced scale, and FIG. 2(*a*) shows miura tie dyeing processing, FIG. 2(*b*) shows plate tie dyeing processing, FIG. 2(*c*) shows miura tie dyeing and tying processing, and FIG. 2(*d*) shows tight tying processing respectively.
Figure 2B:
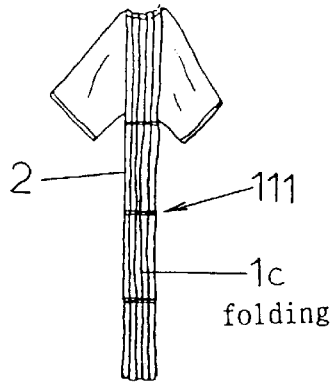
Figure 2C:
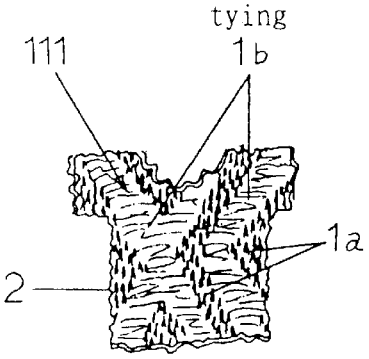
Figure 2D:
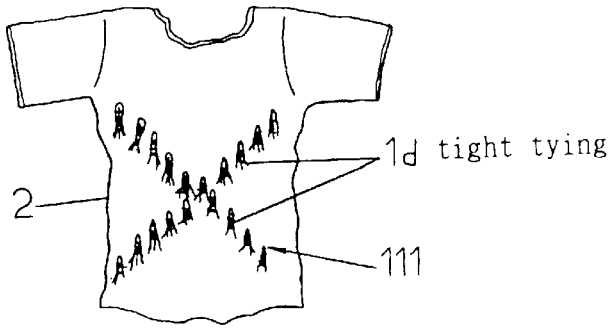

A prescribed portion 111 of a cloth 1 as shown in FIG. 1 is subjected to tying processing such as rolling up *a,* tying 1*b,* folding 1*c* or tight tying 1*d* shown in FIGS. 2(*a*), (*b*), (*c*), (*d*), and forming the traditional tie dyeing process, for example, thereby forming a tying processing product 2.

In FIG. 2(*a*), substantially the whole surface of a cloth 1 is subjected to miura tie dyeing processing. In FIG. 2(*b*), substantially the whole surface of a cloth 1 is subjected to plate tie dyeing processing. In FIG. 2(*c*), substantially the whole surface of a cloth 1 is subjected to miura tie dyeing processing and tying processing. In FIG. 2(*d*), substantially the whole surface of a cloth 1 is subjected to tight tying processing.

The tying processing product 2 is dyed by a conventional dyeing method such as immersion. The dyed cloth (not shown) is subjected to shrinking processing, for example, by heat treatment, chemical treatment or the like, thereby forming a tie dyeing and shrinking clothing piece 3.

For example, in the case of polyester cloth, the heat treatment is performed at a boiling temperature of about 130° C.–140° C. and a time of about 30–40 minutes in order to shrink the tie dyeing clothing piece.

When the cloth is cotton or others, the shrinking process is performed by chemical treatment, for example, alkali treatment.

Figure 3:
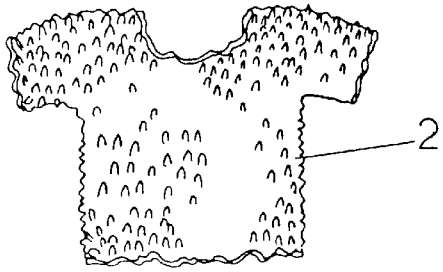
FIG. 3 is a perspective view showing whole cloth utilizing the tie dyeing process as shown in FIG. 2(*a*)
Figure 4:
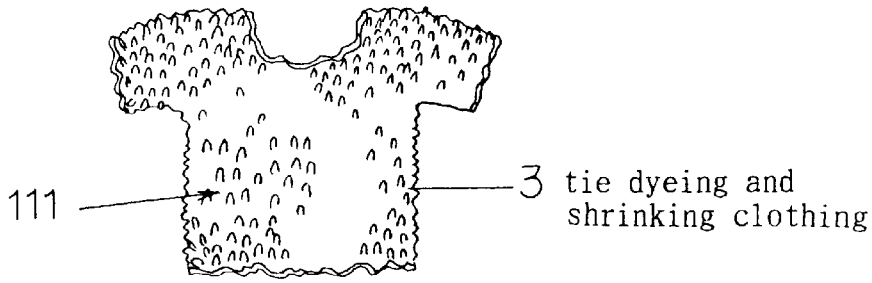
FIG. 4 is a perspective view showing a tie dyeing and shrinking clothing piece utilizing the tie dyeing process as shown in FIG. 2(*a*)

After the heat treatment, a finishing process is performed (refer to FIGS. 3 and 4). In addition, regarding the order of processing of the dyeing and the heat treatment (shrinking), and time and the like for the simultaneous processing, the individual processing, change of the order and the like, are arbitrary or selected depending on various products, cost, simplification of process, facilities, manner of various processings and the like.

Figure 5:
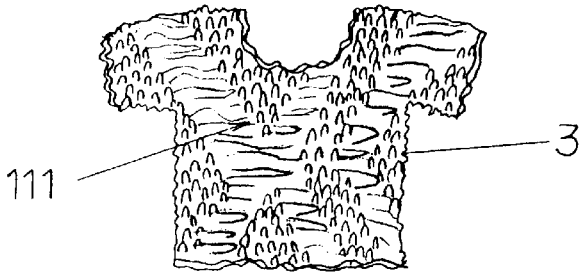
FIG. 5 is a perspective view showing a tie dyeing and shrinking clothing piece utilizing other tie dyeing process.

In FIG. 4, the shrinking process is applied to the whole surface of a tie dyeing and shrinking clothing 3. In FIG. 5, variation is provided in the tie dyeing and shrinking clothing piece 3.

The whole cloth 1 is subjected to the tie dyeing process and then subjected to the shrinking process as to form a tie dyeing and shrinking clothing piece 3, and size of the tie dyeing and shrinking clothing piece 3 is reduced greatly by utilizing the elasticity based on the tie dyeing and shrinking process. Consequently the tie dyeing and shrinking clothing piece 3 can be fitted to a human body, and the figured line of the human body can be enveloped gently without producing creases.

Figure 6:
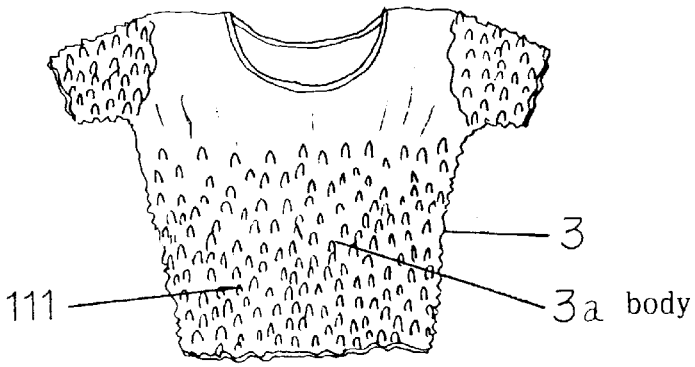
FIG. 6 is a perspective view showing an example where the tie dyeing and shrinking process is applied to a body.
Figure 7:
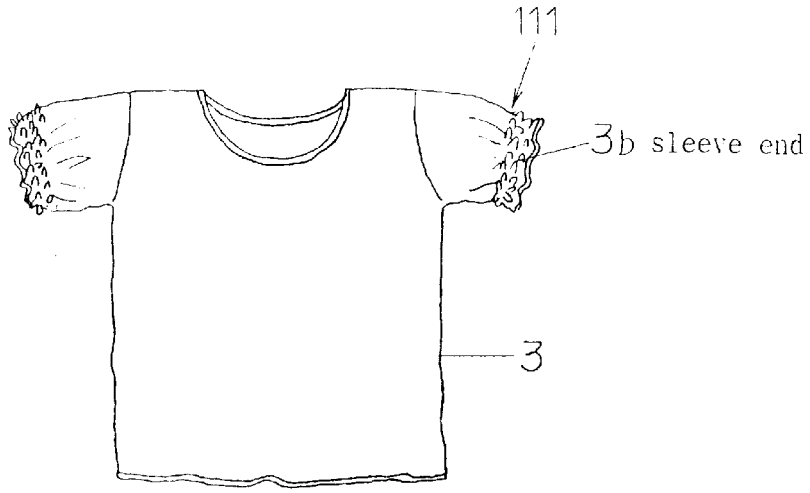
FIG. 7 is a perspective view showing an example where the tie dyeing and shrinking process is applied to sleeve ends.
Figure 8:
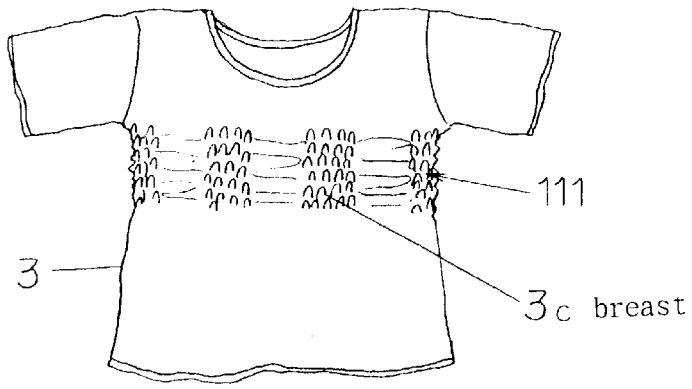
FIG. 8 is a perspective view showing an example where the tie dyeing and shrinking process is applied to a breast.
Figure 9:
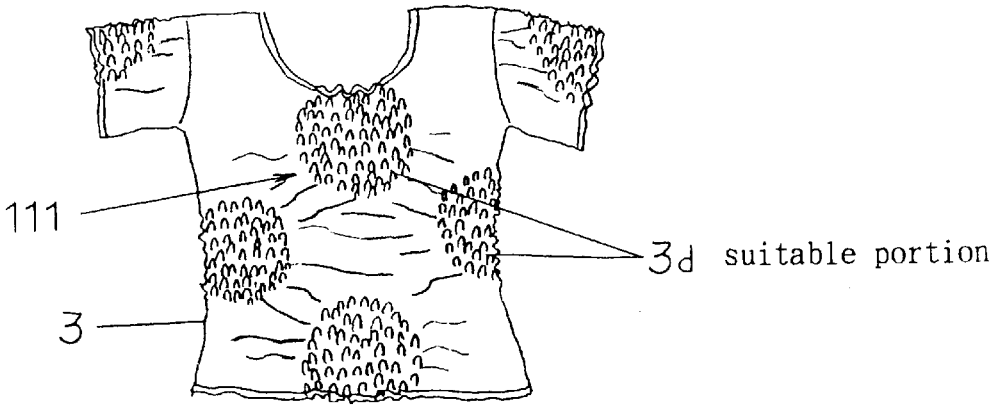
FIG. 9 is a perspective view showing an example where the tie dyeing and shrinking process is applied to suitable portions.
Figure 10:
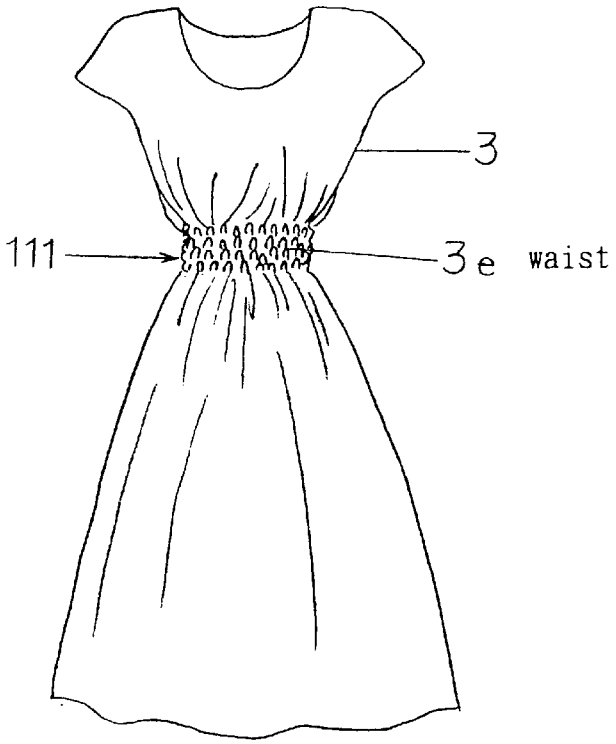
FIG. 10 is a perspective view showing an example where the tie dyeing and shrinking process is applied to a waist.

In FIG. 6, the shrinking process is applied to a body 3*a* of a tie dyeing and shrinking clothing piece 3. In FIG. 7, the shrinking processing is applied to sleeve ends 3*b* of the tie dyeing and shrinking clothing piece 3. In FIG. 8, the shrinking processing is applied to a breast 3*c* of the tie dyeing and shrinking clothing piece 3. In FIG. 9, the shrinking process is applied to suitable portions 3*d* of the tie dyeing and shrinking clothing piece 3. In FIG. 10, the processing of shrinking is applied to a waist 3*e* of the tie dyeing and shrinking clothing piece 3.

In order to obtain fitting to a human body, a portion of a cloth 1 corresponding to a prescribed portion such as a body, a breast, a waist of a suitable portion is subjected to the tie dyeing of process, and then it is subjected to the process of shrinking so as to form a tie dyeing and shrinking clothing piece 3, and the size of the tie dyeing and shrinking clothing piece 3 can be greatly reduced by utilizing the elasticity based on the tie dyeing and shrinking processing.

In an example of dimension indicating the size of the cloth 1 as shown in FIG. 1, the shoulder width is 55 cm, width in breast and body is 70 cm, height is 80 cm and whole shoulder width with sleeves developed is 115 cm.

Figure 13:
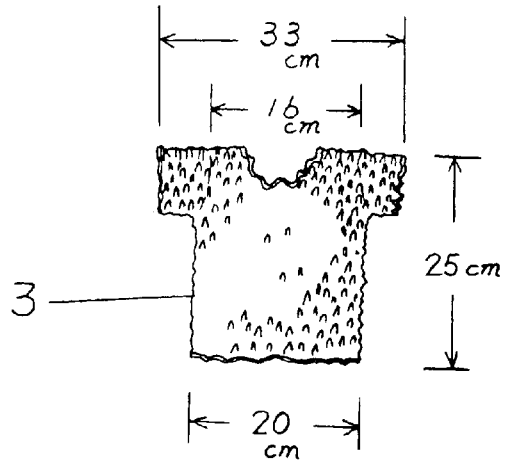
FIG. 13 is a diagram showing dimension indication that the tie dyeing and shrinking clothing piece as shown in FIG. 4 is in a shrunken state.
Figure 14:
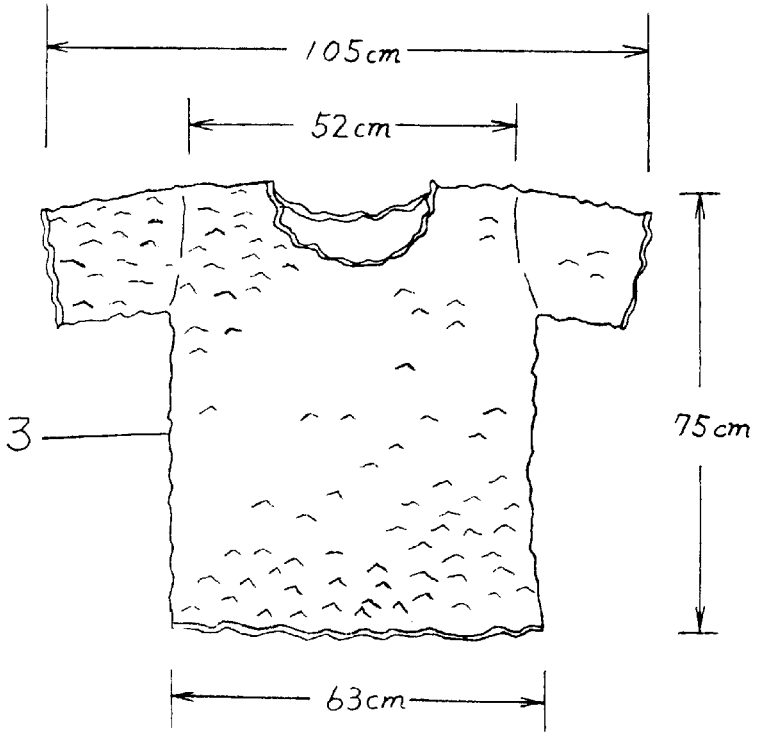
FIG. 14 is a diagram showing dimension indication that the tie dyeing and shrinking clothing piece as shown in FIG. 4 is in an enlarged state.

FIG. 13 shows an example of dimension for the tie dyeing and shrinking clothing piece 3 as shown in FIG. 4 in the shrunken state, where the shoulder width is 16 cm, width in breast and body is 20 cm, height is 25 cm and whole shoulder width with sleeves developed is 33 cm. Also FIG. 14 shows an example of dimension for the tie dyeing and shrinking clothing piece 3 as shown in FIG. 4 in the enlarged state, where the shoulder width is 52 cm, width in breast and body is 63 cm, height is 75 cm, and whole shoulder width with sleeves developed is 105 cm.

Figure 11:
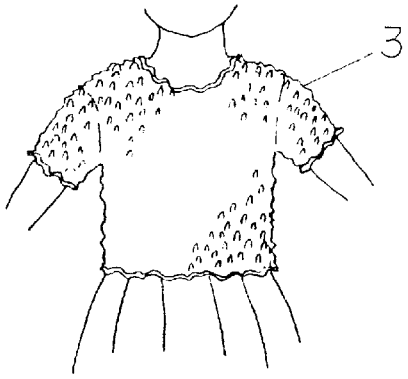
FIG. 11 is a diagram showing an example where the tie dyeing and shrinking clothing piece as shown in FIG. 4 is worn by a child.
Figure 12:
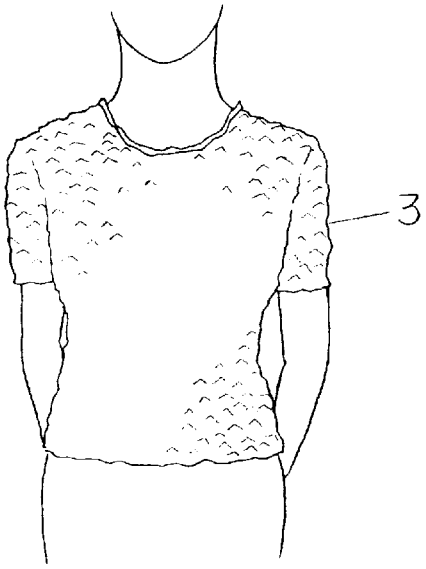
FIG. 12 is a diagram showing an example where the tie dyeing and shrinking clothing piece as shown in FIG. 4 is worn by an adult.

Consequently, in the embodiment, since a blouse of the prescribed size can be manufactured in a state that it can be fitted to a human body and may be extended or contracted, for example, the blouse of the prescribed size can be utilized by an adult and a child by utilizing the elasticity. FIG. 11 shows an example that the tie dyeing and shrinking clothing piece 3 as shown in FIG. 4 is worn by a child, and FIG. 12 shows an example that the tie dyeing and shrinking clothing 3 as shown in FIG. 4 is worn by an adult.

What is claimed is:

1. A method of manufacturing clothing, comprising the steps of:

providing an article of clothing having a single large size;

subjecting said article to a tying process;

subjecting said article of clothing to a tie dyeing process after the tying process; and subjecting said article of clothing to a shrinking process to obtain a tie-dyed, shrunk article of clothing having an entirely reduced size with elasticity due to the tie dyeing and shrinking process, so that an entire portion of said single large size article of clothing fits a wearer of any size.

2. The method of claim 1, wherein said tying step includes at least one of rolling up, tying, folding, and tight tying.

3. The method of claim 1, wherein the shrinking step includes at least one of shrinking by heating and shrinking by chemical treatment.

4. An article of clothing manufactured by the method of claim 1.

5. A method of manufacturing clothing, comprising the steps of:

providing an article of clothing having a prescribed portion where elasticity is desired;

subjecting said article of clothing to a tying process;

subjecting said article of clothing to a tie dyeing process after the tying process; and subjecting said prescribed portion of said article of clothing to a shrinking process to obtain an article of clothing having a partially shrunk portion with elasticity due to said tie dyeing and shrinking process so that said shrunk portion fits any size of a wearer.

6. The method of claim 5, wherein said tying step includes at least one of rolling up, tying, folding, and tight tying.

7. The method of claim 5, wherein the shrinking step includes at least one of shrinking by heating and shrinking by chemical treatment.

8. An article of clothing manufactured by the method of claim 5.

* * * * *